US008061420B2

(12) United States Patent
Hadley

(10) Patent No.: US 8,061,420 B2
(45) Date of Patent: Nov. 22, 2011

(54) DOWNHOLE ISOLATION TOOL

(76) Inventor: Keith Hadley, Stafford, TX (US)

( * ) Notice: Subject to any disclaimer, the term of this patent is extended or adjusted under 35 U.S.C. 154(b) by 206 days.

(21) Appl. No.: 12/406,609

(22) Filed: Mar. 18, 2009

(65) Prior Publication Data

US 2009/0242188 A1 Oct. 1, 2009

Related U.S. Application Data

(60) Provisional application No. 61/039,491, filed on Mar. 26, 2008.

(51) Int. Cl.
*E21B 33/12* (2006.01)
*E21B 23/06* (2006.01)

(52) U.S. Cl. ..... 166/125; 166/387; 166/182

(58) Field of Classification Search ..... 166/123, 166/125, 182, 382, 387, 216, 217
See application file for complete search history.

(56) References Cited

U.S. PATENT DOCUMENTS 2,970,651 A * 2/1961 Roberts ..... 166/212
3,298,440 A * 1/1967 Current ..... 277/340
4,146,093 A * 3/1979 Horvath et al. ..... 166/120
4,153,109 A * 5/1979 Szescila ..... 166/382
4,349,071 A * 9/1982 Fish ..... 166/124
4,708,202 A * 11/1987 Sukup et al. ..... 166/123
4,898,239 A 2/1990 Rosenthal
5,220,959 A * 6/1993 Vance, Sr. ..... 166/187
5,511,620 A 4/1996 Baugh et al.
6,581,681 B1 6/2003 Zimmerman et al.
6,772,844 B2 8/2004 Lloyd et al.
7,165,622 B2 1/2007 Hirth et al.
2004/0159445 A1 8/2004 Hazel et al.
2004/0226724 A1 11/2004 Hirth et al.
2007/0029080 A1 2/2007 Moyes

* cited by examiner

*Primary Examiner* — Kenneth L Thompson

(74) *Attorney, Agent, or Firm* — Usha Menon; Gabriel Gonzalez; D'Ambrosio & Menon, LLP

(57) ABSTRACT

An isolation tool for use in a tubular. The isolation tool comprising gripping members and sealing members to engage and seal the isolation tool to an inner wall of the tubular at a desired location in the tubular. The isolation tool further comprising a locking system that allows the isolation tool to be set in a desired position within the tubular. The locking system prevents the isolation tool from any further movement which would unset it from the desired position.

25 Claims, 7 Drawing Sheets

DOWNHOLE ISOLATION TOOL

RELATED APPLICATIONS

This patent application takes priority to U.S. Provisional Application Ser. No. 61/039,491 filed Mar. 26, 2008.

FIELD OF THE INVENTION

Embodiments described herein generally relate to an apparatus and method for sealing and isolating an area of a tubular in a wellbore.

BACKGROUND OF THE INVENTION

In the drilling and production of hydrocarbon producing wells, a wellbore or borehole is drilled into the Earth. The wellbore is typically lined with a casing and cement is pumped into the annulus between the casing and the wall of the wellbore in order to isolate formations found in the wellbore from the casing. With the casing in place various operations may be performed in the wellbore, including but not limited to perforating, production, artificial lifting, a frac operation, cutting a lateral, etc. There are many applications in well drilling, servicing, and completion which require isolation and sealing off of particular zones within the well.

Packers, frac plugs and bridge plugs are commonly run into a wellbore and used to isolate one portion of a wellbore from another portion. A typical packer is run into a wellbore and then set using slips which engage the casing. Bridge plugs and frac plugs are installed in a similar manner to a typical packer. Packers, bridge plugs, and frac plugs are installed to temporarily block the wellbore and provide a barrier against which pressure can be developed to treat a hydrocarbon-bearing formation adjacent the wellbore. In all of these instances, the tool is typically disconnected from a run-in string of tubulars and left in place during the operation. Thereafter, the tools can be retrieved and brought to the surface.

SUMMARY OF THE INVENTION

This invention relates to a wellbore isolation tool which is easily milled from the wellbore itself. In one embodiment, the isolation tool is a plug used to seal off and isolate one part of the wellbore from another. In one aspect of this invention, the isolation tool comprises a gripping member with a locking system that ensures the plug will not disengage from a tubular.

In one embodiment of this invention, the downhole isolation tool comprises a mandrel having an outer surface and one or more blocks located on the outer surface of the mandrel. One or more seals are positioned on the outer circumference of the mandrel between the blocks. As the blocks move towards each other, the seals, which may be elastomeric, are squeezed between the blocks and bulge outwardly to seal the tubular. One or more gripping members may also surround the mandrel, the gripping members comprising one or more spikes adapted to engage an inner diameter of a tubular. A locking system is positioned between the blocks and the mandrel, the locking system having one or more one-way stops and one or more engagement members for engaging with the one-way stops.

Another aspect of this invention comprises a method of sealing a tubular in a wellbore. During the method an isolation tool is run into the tubular and located at a setting location. One or more blocks are moved in a first direction but prevented from moving in a second direction by means of a locking system. The one or more gripping members are moved radially away from the isolation tool thereby engaging an inner wall of the tubular in response to the one or more blocks moving in the first direction. As the blocks are moved in a first direction towards a second block, a seal is compressed between the two blocks thereby causing the seal to engage with the inner wall of the tubular.

Another embodiment of the downhole tool comprises a conveyance for conveying the tool into a wellbore. A mandrel may be coupled to the conveyance. The mandrel may have one or more blocks surrounding its outer surface. In one aspect of this embodiment, the blocks have block ramps. One or more gripping members having slanted shoulders are located between the blocks. An outer circumference of the gripping members may comprise spikes; the spikes are configured to engage an inner wall of a tubular when the blocks move towards each other thereby forcing the gripping members to move outwardly from the mandrel and attach to the tubular to lock the downhole isolation tool in place. A sealing member comprising elastomeric material for engagement with the inner diameter of the tubular may also be located between two blocks so that movement of one block towards a second block cause the seal to bulge outwardly and engage with the inner wall of the tubular. A locking system is employed to maintain the one or more gripping members and the sealing member in an engaged position with the inner wall of the tubular. In one aspect of this invention, the locking system comprises one or more one way stops and one or more engagement members, each one-way stop defining at least one groove, and each engagement member comprising one or more pins to engage with the one-way stop. The one or more pins may be biased toward the one-way stops.

DETAILED DESCRIPTION

Figure 1:
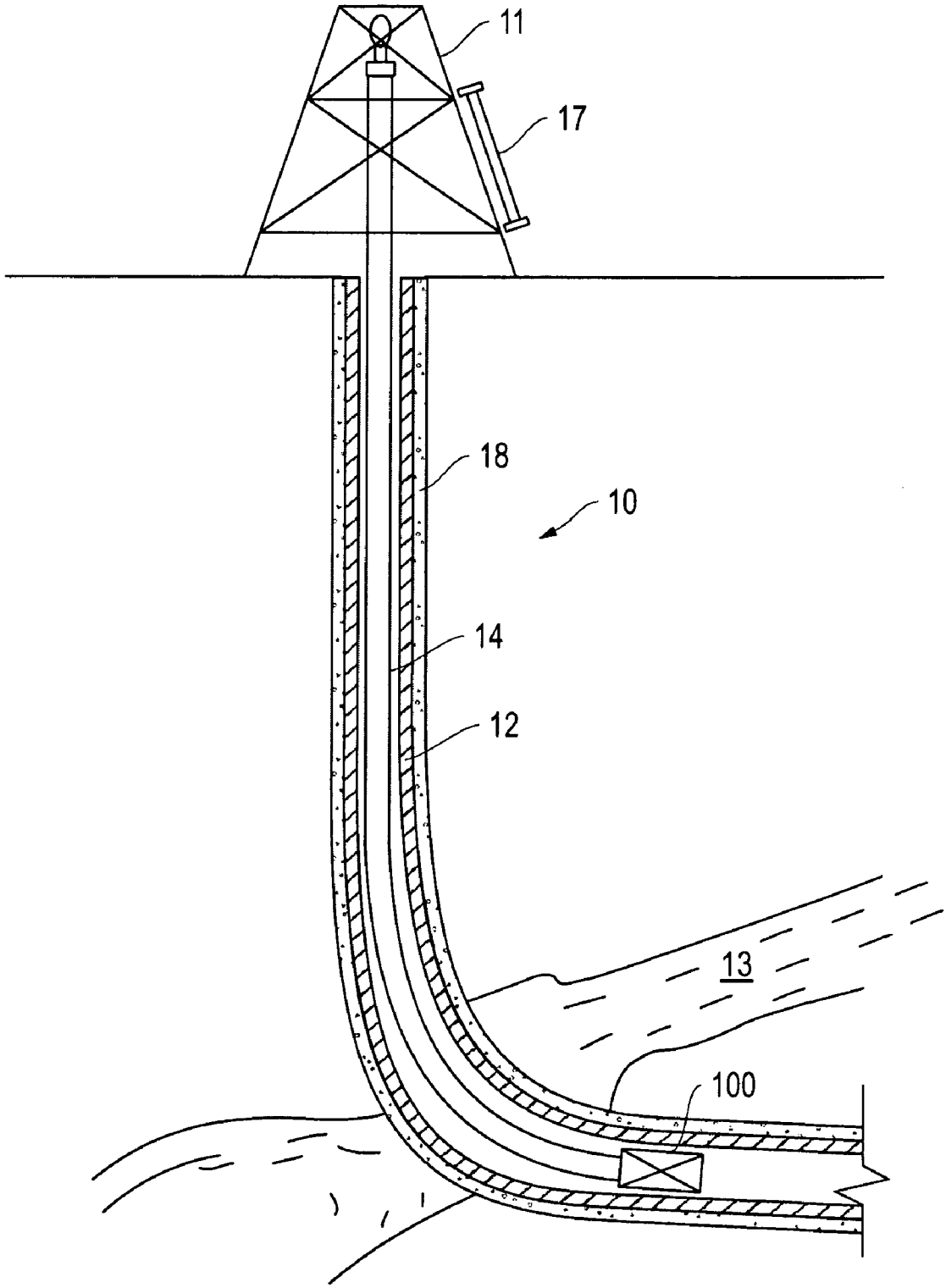
FIG. 1 is a schematic view of a wellbore.

FIG. 1 is a schematic view of a wellbore 10 according to one embodiment described herein. The wellbore 10 includes a tubular 12 for isolating the wellbore from one or more hydrocarbon producing formations 13. Cement 16 is typically filled into an annulus 18 between the tubular 12 and the wellbore 10 to isolate the wellbore 10 from the tubular 12. A drilling rig 11 is typically constructed over the wellbore 10. The drilling rig 11 is used to facilitate the running of tools and the tubular 12 into and out of the wellbore 10. An isolation tool 100 is shown being run into the wellbore 10 on a conveyance 14. In operation, the isolation tool 100 is run into the wellbore 10 until it reaches a desired location in the wellbore 10. Upon reaching the desired location, an operator sets the isolation tool 100 in the wellbore 10 so that the isolation tool 100 grips the inner diameter of the tubular 12 thereby sealing the tubular 12 at the desired location. The isolation tool 100 comprises a sealing system 200, one or more blocks 208 surrounding a mandrel 212, and a locking system 300. In one embodiment, the isolation tool 100 is set in place by moving one or more blocks 208 in a first direction. The sealing system 200 may comprise one or more seals, 206, one or more gripping members 204 and one or more gripping member retainers 210.

Figure 3:
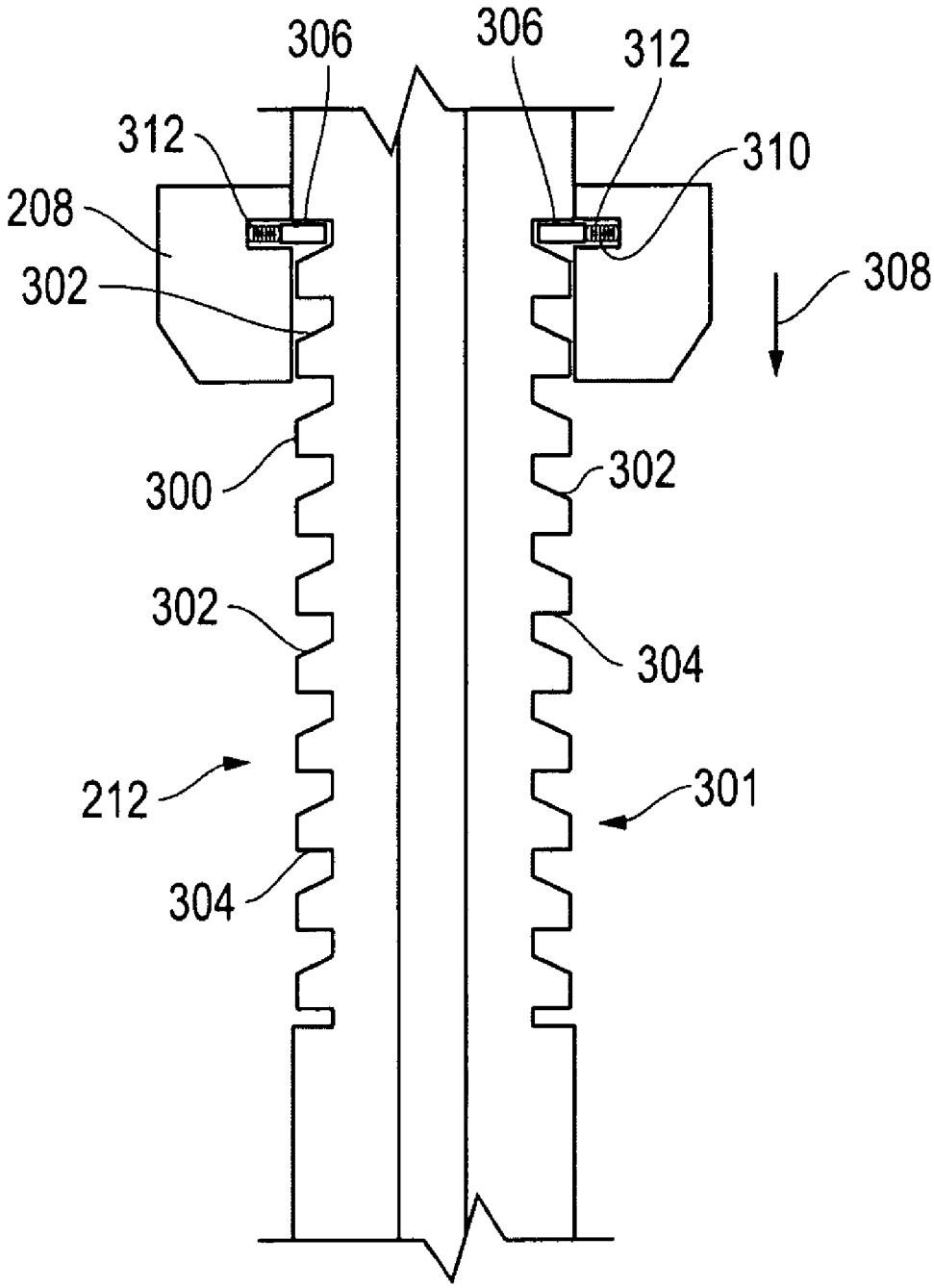
FIG. 3 is a schematic cross-sectional view of a mandrel.

As seen in FIGS. 1 and 3, a locking system 300 prevents at least one of the one or more blocks 208 from moving in a second direction. The locking system 300 has one or more one-way stops 301, or ratchets, that allow one or more engagement members to move in the first direction or setting direction, relative to one or more one way stops. The engagement members are allowed to travel in the first direction relative to the one-way stops; however, the one-way stops prevent the engagement members from moving the second direction or unsetting direction. According to one embodiment, as the locking system 300 moves in the first direction the isolation tool engages the inner diameter of the tubular 12. The locking system 300, however prevents the isolation tool 100 from disengaging the inner diameter of the tubular 12. Thus, according to one embodiment, the isolation tool 100 may be set in the tubular 12 at the desired location, but it may not be unset due to the one-way stops, or ratchets. The isolation tool 100 may be composed substantially of a composite material. In this embodiment, the isolation tool may be easily milled or drilled out of the tubular 12 after it has been set in place.

FIG. 1 illustrates one embodiment of the invention in which tubular 12 is a casing and the isolation tool 100 is designed to engage the inner diameter of the casing. Although shown as a casing, it should be appreciated that the tubular 12 may be any tubular including, but not limited to, a liner, a production tubing, a drill string, an open wellbore, or coiled tubing. The isolation tool 100 may be sized to fit into any tubular so that it engages and/or seals the tubular.

The conveyance 14, shown in FIG. 1, may be a drill string used to lower the isolation tool 100 into the tubular 12. The drill string may consist of several pipe stands 17 which are assembled on the drilling rig 11 and lowered into the wellbore 10. Although the conveyance 14 is shown as a drill string, it should be appreciated that the conveyance 14 may be any conveyance including, but not limited to, a coiled tubing, a wire line, a slick line, a co-rod, a casing, a production tubing, a liner, a rope, or a fluid used to pump the isolation tool 100 into the tubular 12.

Figure 2:
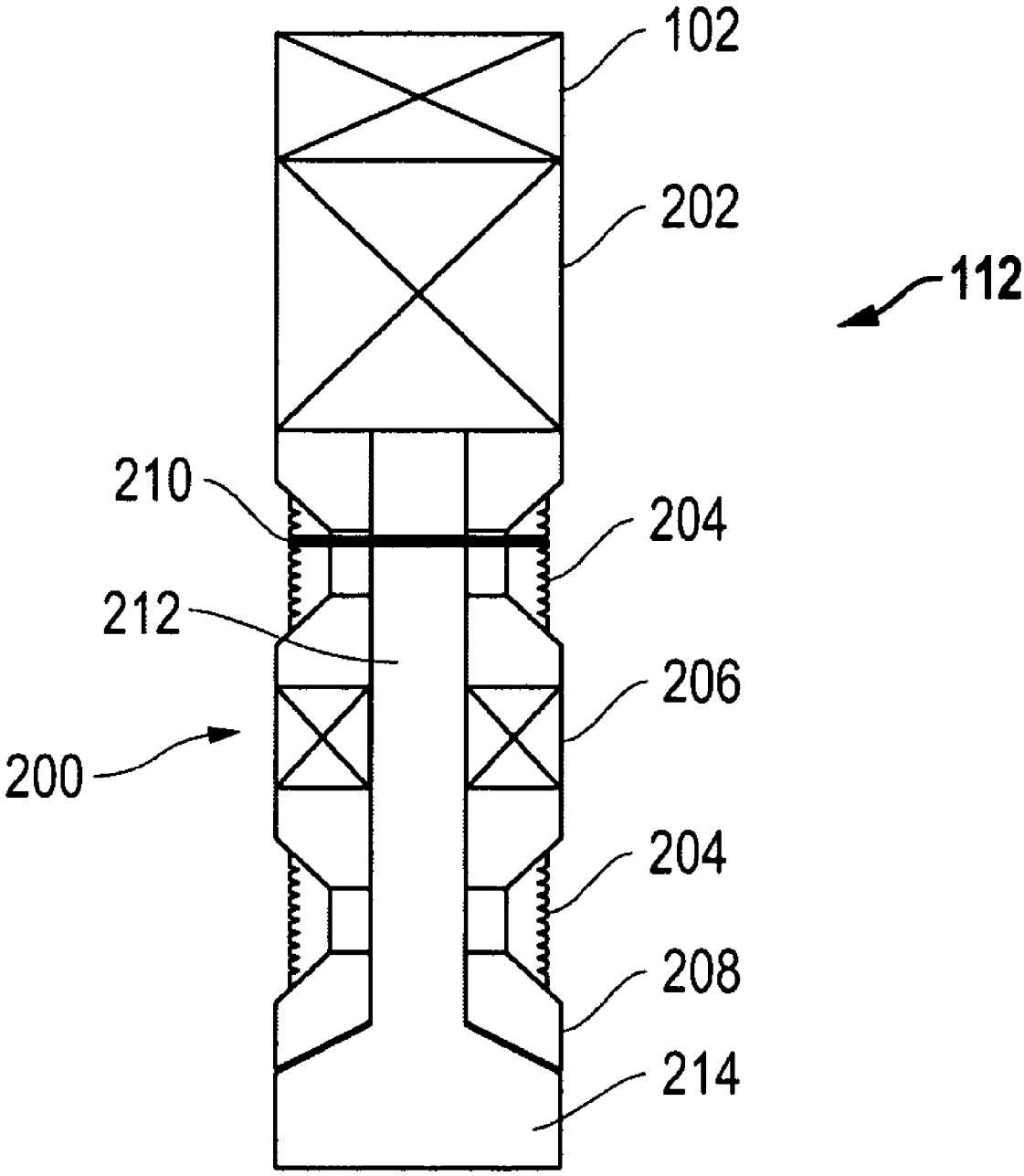
FIG. 2 is a schematic view of a wellbore isolation tool.

A schematic view of the isolation tool 100 is shown in FIG. 2. The isolation tool 100 may comprise a connector end 102, an optional actuator 202, one or more gripping members 204, one or more seals 206, one or more blocks 208, an optional gripping member retaining member 210, a mandrel 212 and a nose end 214 according to one embodiment. The isolation tool 100 is shown in the un-actuated position in FIG. 2. In the un-actuated position, the gripping members 204 may have a smaller outer diameter than the largest diameter of the isolation tool 100. This allows the isolation tool 100 to be run into the tubular 12 without the gripping members inadvertently gripping onto the inner diameter of the tubular 12 before the operator wishes to set it in place.

The connector end 102 may couple the isolation tool 100 to the conveyance 14. The connecter end 102 may be any suitable connector, so long as the connector end 102 is capable of securing the conveyance 14 to the isolation tool 100. In one embodiment, the connector end 102 may be a frangible connection capable of breaking to release the isolation tool 100 when a user desires to disconnect the isolation tool 100 from the drilling string to set it into position. Although described as a frangible connection it should be appreciated that the connector end 102 may be any suitable connecter including, but not limited to, a welded connection, a threaded connection, and a pin connection. When ready to disconnect, pressure is applied to the connector end 102 until it shears.

As seen in FIGS. 1, 2 and 3, the locking system 300 allows the mandrel 212 to move relative to the blocks 208, the seal 206 and/or the gripping member 204 in the first direction, or setting direction. The locking system 300 prevents the mandrel 212 from moving in the second direction or unset direction. Thus, once the actuation of the isolation tool 100 is initiated and the gripping members 204 and seal 206 have engaged the inner diameter of the tubular 12, the locking system prevents the mandrel 212 from moving in the second direction thereby inadvertently unsetting the isolation tool 100. The locking system 300 comprises one or more one way stops 301 and one or more engagement members 306 for engaging the stops. The one way stops 301, grooves for example, may be located on outer diameter of the mandrel while the engaging members 306 may be located on the inner diameter of the blocks 208 and/or seal 206. In another embodiment, not shown, the one way stops may be located on inner diameter of the blocks and/or seal while the engaging members are located on the outer diameter of the mandrel, or any combination thereof.

Figure 7:
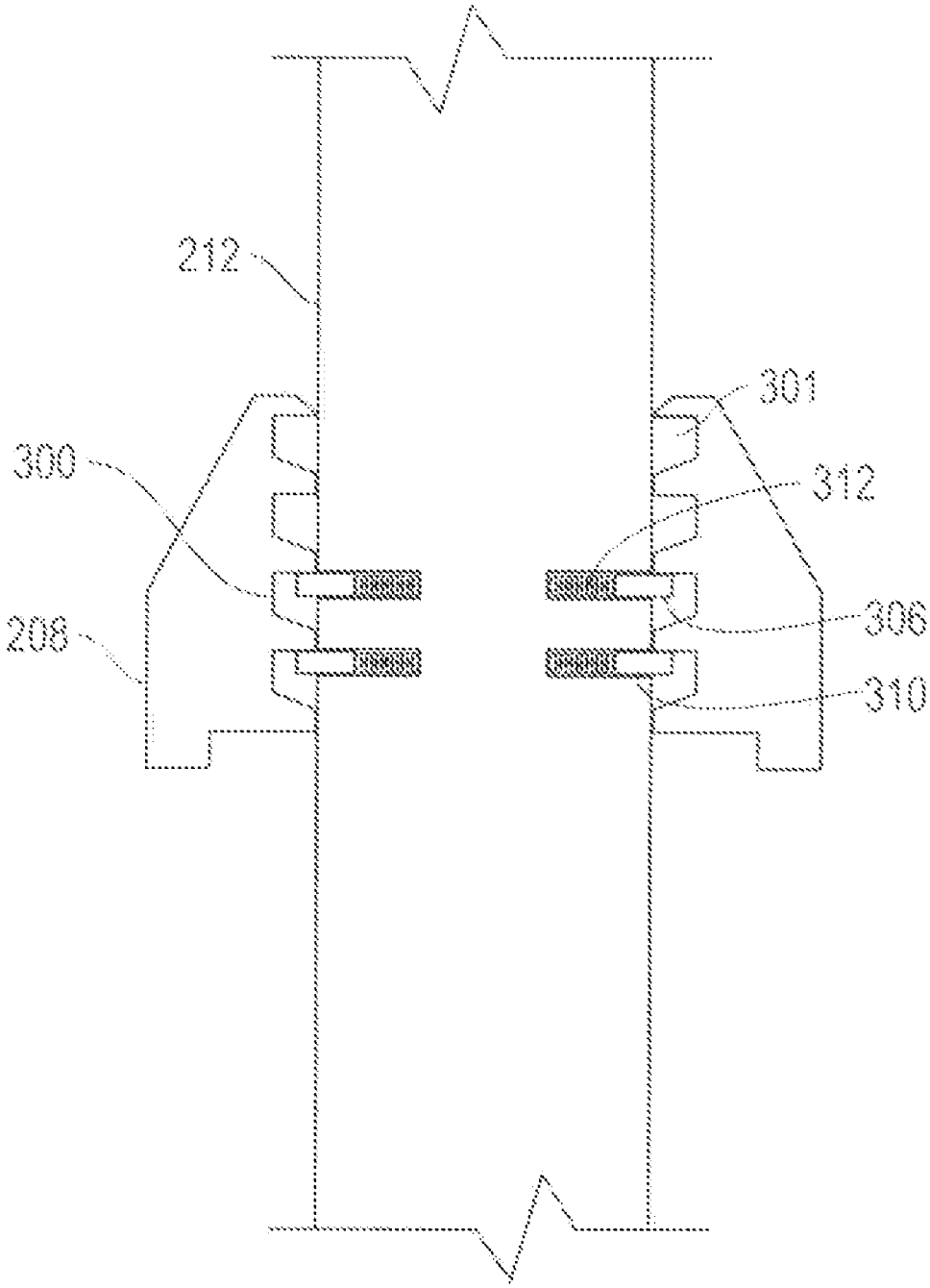
FIG. 7 is a schematic cross-sectional view of a mandrel.

The mandrel 212, as shown in FIG. 2, supports the sealing system 200. The sealing system 200 may comprise one or more seals 206, the gripping members 204, and the blocks 208. As shown in FIG. 3, the mandrel 212 includes the one way stops. The one way stops 301, as shown in FIG. 3, comprise one or more grooves 301 defined in the mandrel. The grooves 301, as shown, are defined by a sloped shoulder 302 and a flat shoulder 304 of the outer perimeter of the mandrel 212. The sloped shoulders 302 allow one or more engagement members 306 of the blocks 208 to move past the grooves 301 in the first direction 308. The flat shoulders 304 prevent the engagement members from moving in the second direction. In one embodiment, the engagement members 306, as shown, comprise one or more pins 306 held in a recess 310 in the inner diameter of the block 208. In one embodiment, the pins are spring-loaded pins that are used to lock the blocks in place. Alternatively, the recess 310 may include a biasing member, such as a spring 312 configured to bias the engagement members 306 into the one or more one way stops 301. Although the engagement members 306 are illustrated as a pin, it should be appreciated that the engagement members 306 may be any suitable member capable of locking relative movement between the mandrel 212 and the block 208 including but not limited to, a boss, a knob, a ring, or a profile. Further, it should be appreciated that the one way stop 301 may be any suitable member capable of locking the engagement member 306 into place. Further, it should be appreciated that the one way stops 301 and engagement members 306 may be located on any combination of the mandrel 212 and the blocks 208 and or seals 206. For example, as shown in FIG. 7, the one way stops 301 may be disposed on at least a portion of an inner surface of the blocks 208.

In an additional embodiment, the one way stops may have vertical grooves, not shown, which prevent the engagement members from rotating around the mandrel 212 during operation. Thus, the vertical grooves would allow the blocks 208 to travel in the first direction during the setting of the isolation tool 100 but would not allow the mandrel to rotate relative to the one or more blocks 208 and/or the seal 206.

As shown in one embodiment, the seal 206 is an elastomeric member which surrounds the mandrel 212. The elastomeric member is compressed between the blocks, as will be described in more detail below, thereby expanding the seal radially away from the mandrel 212 and into engagement with the inner diameter of the tubular 12. It should be appreciated that the seal 206 may be any suitable seal used for packers, bridge plugs and/or frac plugs, including but not limited to, a fluid inflated packer.

Figure 4:
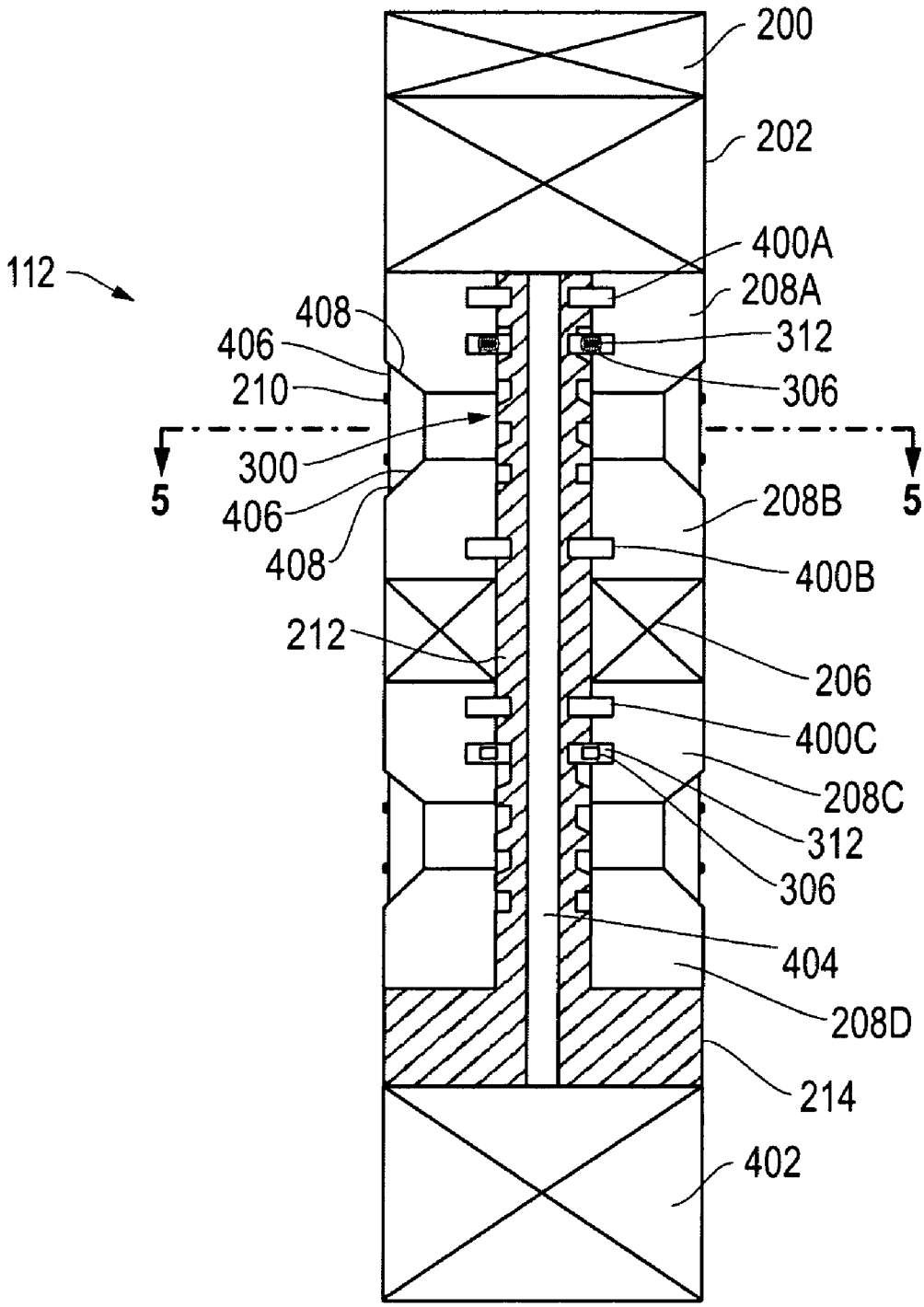
FIG. 4 is a schematic view of a wellbore isolation tool.

As shown in FIG. 4, the isolation tool 100 may include one or more frangible members 400A, 400B, 400C. Shear pins are an example of frangible members 400 used with the isolation tool 100 to temporarily hold the isolation tube in place. A material is said to be frangible if through deformation it tends to break up into fragments, rather than deforming plastically and retaining its cohesion as a single object. A common cookie or cracker are examples of frangible materials, while fresh bread, which deforms elastically is not frangible.

The frangible members 400A, 400B, 400C may be adapted to hold one or more portions of the isolation tool 100 in place until the isolation tool 100 is to be set in the tubular 12. The frangible members 400A, 400B, 400C are shown as being located on the first, second, and third block 208A, 208B, 208C from the connector end 102 of the isolation tool 100; however, the frangible members 400A, 400B, 400C may be located on any of the blocks and/or seal 206. The frangible members 4400A, 400B, 400C couple the blocks 208A, 208B, 208C to the mandrel 212, according to one embodiment. The frangible members 400A, 400B, 400C hold the blocks stationary relative to the mandrel 212 until a force large enough to break the frangible member 400A, 400B, 400C is applied. When a large enough force is applied to the frangible member 400A, 400B, 400C, the frangible members 400A, 400B, 400C breaks thereby allowing that particular block 208A, 208B, 208C to move relative to the mandrel 212. The frangible members 400A, 400B, 400C may be designed to break at varying loads thereby allowing one or more blocks 208A, 208B, 208C to move in sequence if necessary. It should be appreciated that the frangible members 40400A, 400B, 400C may be any suitable member capable of holding the block in place until a particular load is applied to the frangible member 400A, 400B, 400C including but not limited to, a shear pin or a cotter pin.

Figure 5A:
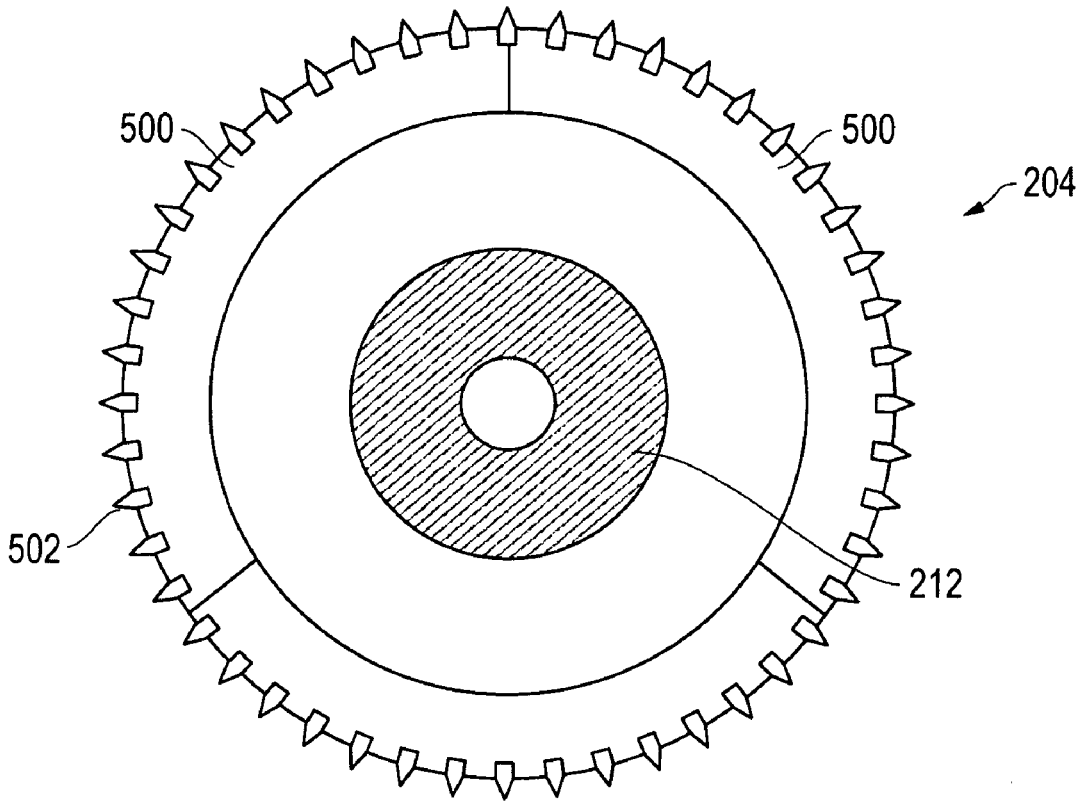
FIG. 5A is a cross sectional schematic view of a wellbore isolation tool.

As illustrated in FIGS. 2 and 4, in one embodiment of this invention the isolation tool 100 comprises gripping members that attach to the inner wall of the tubular 12 to set and keep the isolation tool 100 in a desired position within the tubular 12. In one embodiment, the gripping members 204 comprise expansion grips having pins or spikes that attach to the side walls of the tubular 12. The gripping members 204 may be configured to move radially away from the mandrel 212 when the one or more blocks 208 move relative to the mandrel 212. As shown FIG. 2, the gripping members 204 comprise one or more members which substantially surround the mandrel 212. The one or more gripping members comprise slanted shoulders 406 and the one or more blocks comprise block ramps 408, the block ramps 408 may be positioned adjacent the slanted shoulders 406 of the gripping members. As the blocks 208 move toward one another, a slanted shoulder 406 (illustrated in FIG. 4) of the gripping member 204 rides up a block ramp 408 of at least one of the blocks 208. The slanted shoulder 406 and/or the block ramp 408 push the gripping member 204 radially away from the mandrel 212 as the blocks 208 move towards each other. A cross-sectional top view of the gripping members 204 is shown in FIG. 5A. FIG. 5A shows the gripping member 204 as three segmented semi-circular portions 500. The semi-circular portions 500 help facilitate the radial movement. It should be appreciated that there may be any number of semi-circular portions 500 including but not limited to one. The external surface of the gripping members 204 is designed to grip the inner diameter of the tubular 12. As shown in FIG. 5, there are several pointed spikes 502 embedded into the outer surface of the gripping members 204. The spikes 502 grip into the tubular 12 thereby preventing longitudinal or radial movement of the isolation tool relative to the tubular 12 once set in the tubular 12. The spikes 502 are removable, therefore they are easily interchangeable with another gripping design suited to the tubular 12 the isolation tool 100 is being used in. Although shown as spikes 502, it should be appreciated that any suitable gripping surface may be used on the exterior of the gripping members including but not limited to teeth.

Figure 5B:
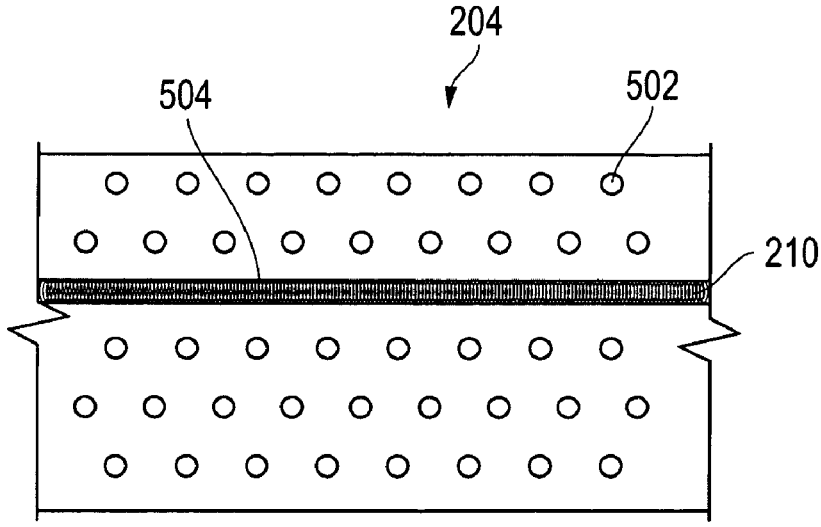
FIG. 5B is a front view of a gripping member of a wellbore isolation tool.

The retaining member 210 is shown in more detail in a front view of a portion of the gripping members 204 in FIG. 5B. The retaining member 210, as shown, is a coiled spring designed to bias the gripping members 204 toward the mandrel 212. The retaining member may rest in a profile or groove 504 formed in the face of the gripping member 204. The biased retaining member 210 prevents the gripping member 204 from inadvertently moving beyond the outer diameter of the isolation tool 100 until the isolation tool 100 is actuated. Although shown as being a coiled spring, it should be appreciated that the retaining member 210 may be any capable of holding the gripping members 204 in a retracted position including, but not limited to, an o-ring, a elastomeric ring, a frangible ring, a biasing member between the gripping member 204 and the mandrel 212, a frangible member between the gripping member 204 and the mandrel 212, or a frangible member between the gripping member and the blocks 208.

The nose end 214 of the isolation tool 100 may be adapted to limit the travel of the closest block 208 to the nose end 214, as shown in FIG. 4, according to one embodiment. The nose end 214, as shown in FIG. 4, is an integral part of the mandrel 212; however, it should be appreciated that the nose end 214 may be a separate member that is coupled to the mandrel 212 during assembly. For example, the nose end may be threaded onto the mandrel 212 thereby allowing a means to unset the isolation tool 100 in the event the isolation tool 100 is inadvertently actuated during assembly. The nose end 214 may be designed to be the terminal end of the tool string as shown in FIG. 2, or may be designed to couple to an additional tool 402, or tool string, as shown in FIG. 4. The additional tool 402 may be any suitable tool for use in a wellbore including, but not limited to, a valve, a perforating gun, a logging tool, a tubular string, a whipstock, a cementing tool, or another isolation tool.

The isolation tool 100 may include a flow path 404. The flow path 404 may allow an operator to flow fluids from one end of the isolation tool 100 to the other depending on the operation. Further, the flow path 404 may be designed to be large enough to run tools through the flow path 404, if necessary. For example, the flow path 404 may be designed to run a perforating gun through the flow path 404 thereby allowing an operator to perform a perforating operation below the isolation tool 100 in the wellbore. The flow path 404 may be used in conjunction with a valve as the additional tool 402. The valve would allow for the control of fluid flow through the isolation tool 100.

The majority of the isolation tool 100 may be composed of a composite material. The composite material allows an operator to easily mill/drill the isolation tool 100 out of the tubular 12 when necessary. In one embodiment, the blocks 208 and the gripping members 204 are made of a composite material, the mandrel 212 is made of an easily millable metal such as aluminum, and the seal is composed of an elastomer.

In an alternative embodiment, the block ramps 408 and/or the slanted shoulder 406 may include a stepped surface rather than a straight ramp. The stepped surface would allow the gripping members to move radially away from the mandrel while mitigating the likelihood that the gripping member 204 moves back toward the mandrel 212 once the blocks begin to set the isolation tool 100.

Figure 6:
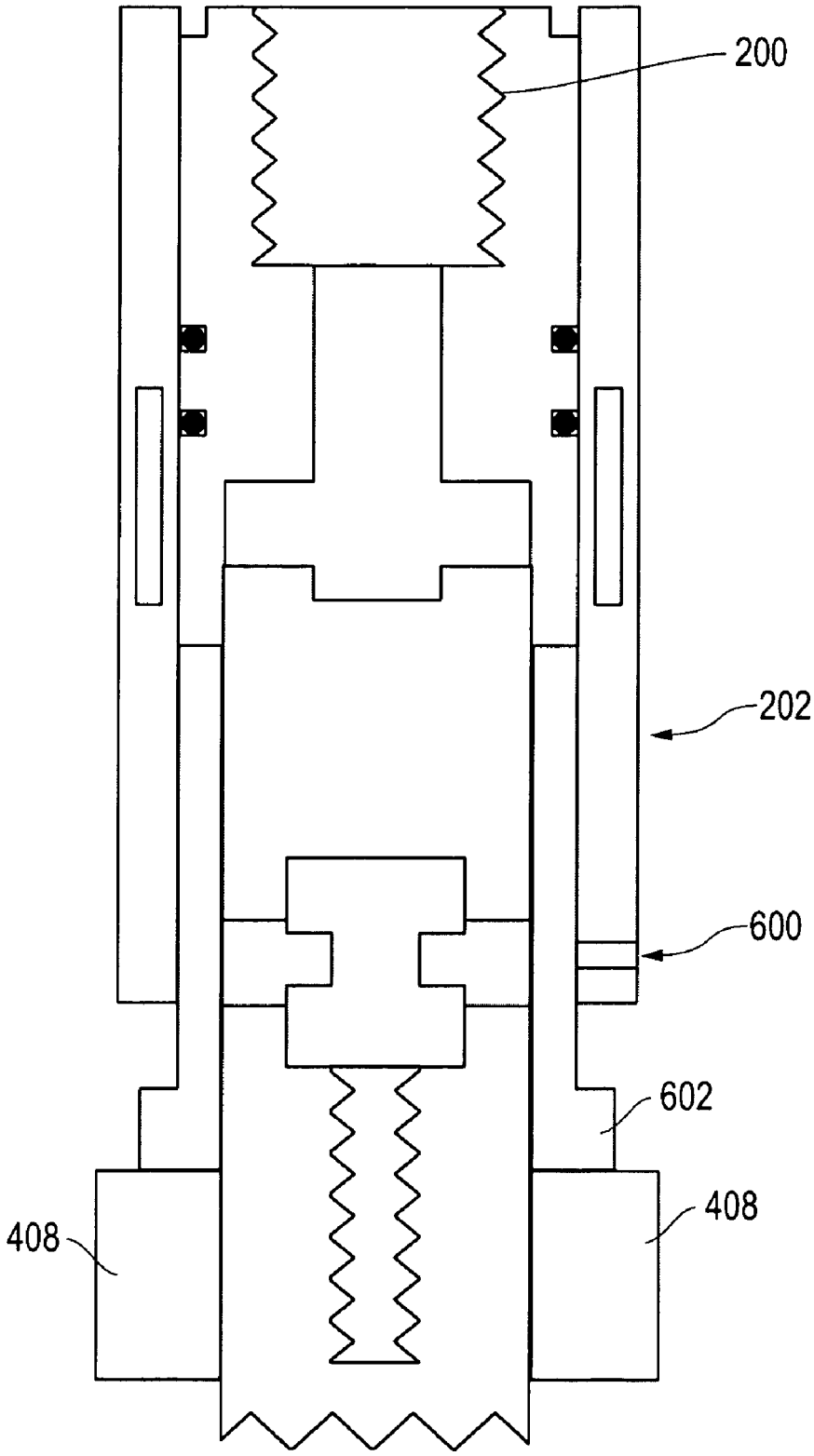
FIG. 6 is a schematic cross sectional view of an actuator.

The actuator 202 may be any actuator capable of actuating the isolation tool 100. The actuator 202 may be a charge, an electrical, mechanical, or fluid operated actuator, or any combination thereof. In one example, the actuator is a fluid operated piston assembly 600, shown in FIG. 6. The piston assembly 600 includes a piston 602 which engages the closest block 408. The piston 602 may have fluid pressure applied to a piston surface 604. The fluid may be supplied through the conveyance 14 as shown in FIG. 6. Further, the actuator 202 may be a charge which is set off and moves the closed block 208 thereby setting the first gripping member 204.

In operation the isolation tool 100 is coupled to the conveyance 14 at the surface of the wellbore 10. The isolation tool 100 is then lowered into the tubular 12 on the conveyance 14 until the isolation tool 100 reaches the desired location in the tubular 12. Upon reaching the desired location the operator actuates the actuator 202. The actuator 202 applies a force to the block 208A closest to the actuator 202. The actuator may apply a force to the block 208A that is large enough to break the frangible member 400A of the block 208A. The actuator 202, or gravity, move the block 208A down relative to the seal 206, the other blocks 208B, 208C and the mandrel 212. This relative downward movement of the block 208A pushes the uppermost gripping member 204 radially away from the mandrel 212 between the block 208A and the block 208B. As the block 208A continues to move down the engagement members 306 associated with the block 208A move past the one way stops in the first direction and are prevented from moving in the second direction. Continued movement of the block 208A moves the gripping member 204 until the spikes 502 engage the inner diameter of the tubular 12. The spikes 502 will grip the tubular with continued movement of the block 208A by the actuator 202, or alternatively by applying an upward force on the conveyance 14 after the gripping members initially grip the tubular 12. The upward movement on the conveyance 14 will move the mandrel 212 and all of the blocks 208B, 208C, 208D with the exception of the block 208A, thereby increasing the gripping force applied by the gripping member 204. With the uppermost gripping members 204 engaged in the inner wall of the tubular 12 continued pulling on the conveyance may be used to set the remainder of the isolation tool 100.

Increasing the pulling force on the conveyance 14 applies a larger force on the mandrel 212 and thereby the frangible member 400B. In one embodiment the second frangible member 400B is designed to shear or break at a smaller load than frangible member 400C. Thus, the increased force on the mandrel 212 eventually breaks the frangible member 400B without breaking the frangible member 400C. The breaking of the frangible member 400B allows the block 208B to move up relative to gripping member 204 and block 208A. This movement locks in the gripping member 204 associated with blocks 208A and 208B. The gripping member 204 eventually reaches the limits of its radial travel and thereby limits the further movement of the block 208B. The blocks 208A and 208B then remain stationary because they are locked with the gripping member 204 into the inner wall of the tubular 12. The seal 206 is then compressed between the blocks 208B and 208C as the mandrel 212 is pulled up. The seal 206 compresses until the annulus between the isolation tool 100 and the tubular 12 is sealed off by the seal 206. When the seal 206 is fully compressed, continued pulling of the conveyance 14 and the mandrel 212 increases the force on the frangible member 400C because the block 208C ceases to move relative to the mandrel 212. The frangible member 400C then shears. With the frangible member 400C broken the block 208C is free to move relative to the mandrel 212. The one way stops and the engagement members allow the mandrel 212 to move in the first direction relative to the block 208C but prevent movement in the second direction.

The one way stops and the engaging members of the block 208C allow the block 208C to move in the first direction relative to the mandrel 212 while preventing the mandrel 212 from moving in the second direction. This allows block 208D to move up relative to the block 208C thereby engaging the gripping member 204 in a similar manner as described above. The pulling of the mandrel 212 continues until the gripping member 204 reaches the limit of its engagement with the inner wall of the tubular 12. The one way stops and engagement members will prevent the mandrel 212 and block 208C from moving in the second or unlocked direction thereby locking the isolation tool 100 into the tubular 12.

The conveyance 14 may then be uncoupled from the isolation tool 100 thereby sealing the tubular 12 at that location. The downhole operations may be performed in the wellbore 10 until the operator desires to remove the isolation tool 100. A milling or drilling tool may be lowered into the tubular 100 and the isolation tool 100 may be milled out of the tubular 12.

Preferred methods and apparatus for practicing the present invention have been described. It will be understood and readily apparent to the skilled artisan that many changes and modifications may be made to the above-described embodiments without departing from the spirit and the scope of the present invention. The foregoing is illustrative only and that other embodiments of the integrated processes and apparatus may be employed without departing from the true scope of the invention defined in the following claims.

The invention claimed is:

1. A downhole isolation tool comprising:

a mandrel, the mandrel comprising an outer surface;

one or more blocks located on the outer surface of the mandrel;

one or more gripping members surrounding the mandrel, the gripping members comprising one or more spikes adapted to engage an inner diameter of a tubular;

one or more seals positioned on the outer surface of the mandrel between the blocks;

a locking system positioned between the blocks and the mandrel, the locking system comprising one or more one-way stops and one or more engagement members for engaging with the one-way stops; and one or more retaining members surrounding the exterior of the gripping members, wherein the retaining members bias the gripping members toward the mandrel.

2. The downhole tool of claim 1, the one or more one-way stops are located on at least a portion of the mandrel, wherein each one-way stop defines at least one groove, the block defines a recess, and each engagement member comprises one or more pins held within the recess defined on the block, the one or more pins biased toward the one-way stops.

3. The downhole tool of claim 1, wherein the one or more one-way stops are located on at least a portion of an inner surface of the at least one of the one or more blocks.

4. The downhole tool of claim 1, each one-way stop defines at least one groove and each engagement member comprises a pin, the pin configured to engage with the groove.

5. The downhole tool of claim 1, wherein the one-way stop comprises a substantially sloped shoulder, sloping in a first direction.

6. The downhole tool of claim 1, further comprising a seal located proximate to at least one of the one or more blocks.

7. The downhole tool of claim 1, wherein the one or more gripping members comprise slanted shoulders and the one or more blocks comprise block ramps, the block ramps positioned adjacent the slanted shoulders of the gripping members.

8. The downhole tool of claim 1, wherein the retaining members further comprise a coiled spring.

9. The downhole tool of claim 1, further comprising two or more frangible members, the frangible members breakable upon exertion of a force, wherein the force to break down of one frangible member is a greater force than the force required to break down a second frangible member.

10. A method of sealing a tubular in a wellbore, comprising:

running an isolation tool into the tubular;

locating the isolation tool at a setting location;

moving one or more blocks in a first direction;

preventing the one or more blocks from moving in a second direction with a locking system according to claim 4;

moving one or more gripping members radially away from the isolation tool and into engagement with an inner wall of the tubular in response to the one or more blocks moving in the first direction; and engaging a seal with the inner wall of the tubular.

11. The method of claim 10, wherein engaging the seal further comprises compressing the seal between a second block and a third block.

12. The method of claim 11, wherein compressing the seal further comprises pulling a mandrel located in the isolation tool thereby moving the third block with the mandrel and relative to the second block and the seal.

13. The method of claim 12, further comprising breaking a frangible member and thereby allowing movement of the third block relative to the mandrel.

14. The method of claim 13, further comprising moving a second griping member into engagement with the inner wall of the tubular by moving a fourth block with the mandrel toward the third block.

15. The method of claim 14, further comprising preventing the third block from moving in a second direction relative to the mandrel by engaging a second locking system.

16. The method of claim 10, further comprising milling the isolation tool out of the tubular.

17. The method of claim 10, wherein moving one or more gripping members into engagement with an inner wall of the tubular comprises forcing spikes positioned on the outer surface of the gripping member into the inner wall of the tubular.

18. A downhole tool, comprising:

a conveyance for conveying the tool into a wellbore;

a mandrel coupled to the conveyance;

one or more blocks comprise block ramps;

one or more gripping members comprising slanted shoulders and an outer circumference, the outer circumference comprising spikes, the spikes configured to engage an inner wall of a tubular;

a sealing member comprising elastomeric material for engagement with the inner diameter of the tubular; and a locking system to maintain the one or more gripping members and the sealing member in an engaged position with the inner wall of the tubular, the locking system comprising one or more one way stops and one or more engagement members, each one-way stop defining at least one groove, and each engagement member comprising one or more pins to engage with the one-way stop, the one or more pins biased toward the one-way stops.

19. The downhole tool of claim 18, wherein the one or more one way stops further comprises a series of grooves cut into a mandrel of the downhole tool.

20. The downhole tool of claim 19 wherein each one-way stop defines at least one groove, the block defines a recess, and each engagement member comprises one or more pins held within the recess defined on the block, the one or more pins biased toward the one-way stops.

21. The downhole tool of claim 19, further comprising one or more biasing members located in one or more holes on an inner diameter of at least one of the moving blocks, the one or more engagement members biased towards the one or more one-way stops by the one or more biasing members.

22. The downhole tool of claim 18, further comprising an actuator for setting the downhole tool in a wellbore.

23. The downhole tool of claim 18, further comprising one or more retaining members for biasing the one or more gripping members toward an ungripped position.

24. A downhole isolation tool comprising:

a mandrel, the mandrel comprising an outer surface;

one or more blocks located on the outer surface of the mandrel;

one or more gripping members surrounding the mandrel, the gripping members comprising one or more spikes adapted to engage an inner diameter of a tubular;

one or more seals positioned on the outer surface of the mandrel between the blocks;

a locking system positioned between the blocks and the mandrel, the locking system comprising:

one or more one-way stops located on at least a portion of the mandrel; and one or more engagement members for engaging with the one-way stops, wherein each one-way stop defines at least one groove, the block defines a recess, and each engagement member comprises one or more pins held within the recess defined on the block, the one or more pins biased toward the one-way stops.

25. A downhole isolation tool comprising:

a mandrel, the mandrel comprising an outer surface;

one or more blocks located on the outer surface of the mandrel;

one or more gripping members surrounding the mandrel, the gripping members comprising one or more spikes adapted to engage an inner diameter of a tubular;

one or more seals positioned on the outer surface of the mandrel between the blocks;

a locking system positioned between the blocks and the mandrel, the locking system comprising one or more one-way stops and one or more engagement members for engaging with the one-way stops, wherein each one-way stop defines at least one groove and each engagement member comprises a pin, the pin configured to engage with the groove.

* * * * *